US011536085B2

(12) United States Patent
Brondex et al.

(10) Patent No.: US 11,536,085 B2
(45) Date of Patent: Dec. 27, 2022

(54) TUBULAR DRIVE ACTUATOR FOR A ROLLER SHUTTER

(71) Applicant: SOMFY ACTIVITES SA, Cluses (FR)

(72) Inventors: Adrien Brondex, Domancy (FR); Nicolas Hafner, Sallanches (FR)

(73) Assignee: SOMFY ACTIVITES SA, Cluses (FR)

( * ) Notice: Subject to any disclaimer, the term of this patent is extended or adjusted under 35 U.S.C. 154(b) by 338 days.

(21) Appl. No.: 16/306,976

(22) PCT Filed: Jun. 8, 2017

(86) PCT No.: PCT/EP2017/064044
§ 371 (c)(1),
(2) Date: Dec. 4, 2018

(87) PCT Pub. No.: WO2017/211997
PCT Pub. Date: Dec. 14, 2017

(65) Prior Publication Data

US 2020/0308907 A1 Oct. 1, 2020

(30) Foreign Application Priority Data

Jun. 8, 2016 (FR) ..... 1655243

(51) Int. Cl.
*E06B 9/68* (2006.01)
*E06B 9/50* (2006.01)
*E06B 9/72* (2006.01)

(52) U.S. Cl.
CPC ..... *E06B 9/50* (2013.01); *E06B 9/72* (2013.01); *E06B 2009/6881* (2013.01)

(58) Field of Classification Search
CPC ..... E06B 9/50; E06B 9/72; E06B 2009/6881; E06B 2009/68; E06B 2009/6809; E06B 2009/6818; E06B 2009/6854
(Continued)

(56) References Cited

U.S. PATENT DOCUMENTS 9,175,514 B2 11/2015 Ducornetz et al.
2010/0282890 A1 11/2010 Ducornetz et al.
(Continued)

FOREIGN PATENT DOCUMENTS

DE 20 2015 008 731 U1 1/2016
EP 0 468 925 A1 1/1992
(Continued)

OTHER PUBLICATIONS

International Search Report and Written Opinion dated Sep. 15, 2017 issued in corresponding application No. PCT/EP2017/064044; w/ English partial translation and partial machine translation (26 pages).

*Primary Examiner* — Nkeisha Smith
(74) *Attorney, Agent, or Firm* — WHDA, LLP

(57) ABSTRACT

The invention relates to a tubular home-automation actuator for driving a winding tube (310), said actuator comprising a head system (100) including a fixed point (1), a bush bearing (2), and a head (3A; 3B). The fixed point (1) forms a bearing surface (11) for guiding the bush bearing (2) in rotation, said bush bearing (2) partially covering a tube (210) of the tubular home-automation actuator. The head (3A, 3B) comprises a bore (32) having a first connecting element (33) that engages with a second connecting element (13) provided on the outer periphery of the fixed point (1) such as to connect the head and the fixed point in a rotatable manner. The head comprises a stop element (31) serving as an axial stop to the bush bearing along the longitudinal axis when the head is mounted on the fixed point.

19 Claims, 5 Drawing Sheets

(58) Field of Classification Search
USPC ..... 248/266
See application file for complete search history.

(56) References Cited

U.S. PATENT DOCUMENTS

| | | | | |
|---|---|---|---|---|
| 2015/0042257 | A1 | 2/2015 | Malausa et al. | |
| 2018/0259033 | A1* | 9/2018 | Basutto | E06B 9/582 |
| 2018/0310745 | A1* | 11/2018 | Giri | A47H 1/13 |
| 2019/0100961 | A1* | 4/2019 | Kutell | E06B 9/50 |

FOREIGN PATENT DOCUMENTS

| | | | |
|---|---|---|---|
| EP | 0 468 925 | B1 | 6/1993 |
| EP | 1 635 031 | A2 | 3/2006 |
| EP | 2 248 987 | A2 | 11/2010 |
| WO | 2013/098108 | A1 | 7/2013 |

* cited by examiner 1
2
21
200
210
230

3A
100
2
211
212
21
210
200
230

1
15
13
11
211
200
210
230

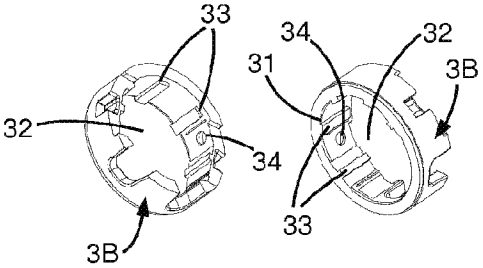
FIG.9B
FIG.9A
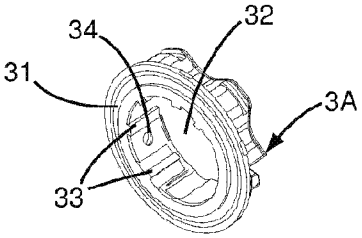
FIG.8B
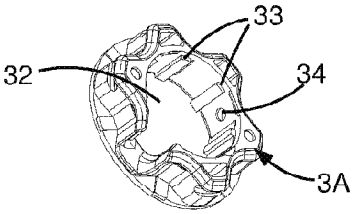
FIG.8A
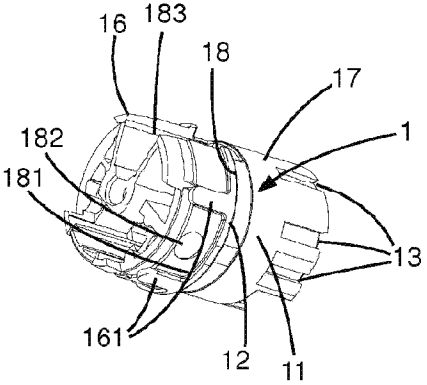
FIG.7B
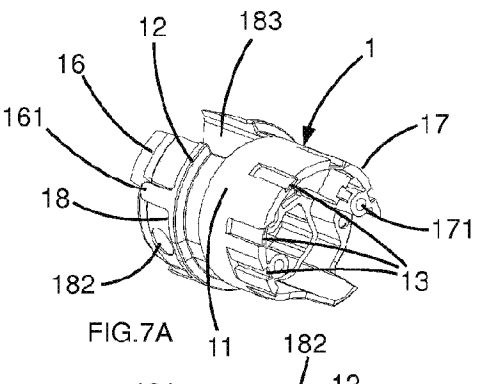
FIG.7A
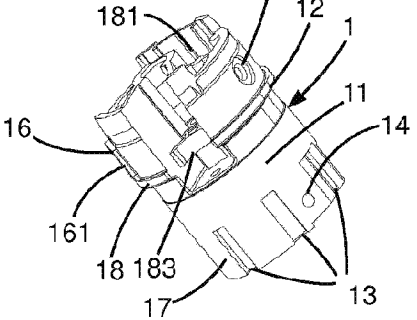
FIG.7C

TUBULAR DRIVE ACTUATOR FOR A ROLLER SHUTTER

The invention relates to a tubular home automation actuator for driving a winding tube intended to receive a roll-up element, such as a blind, a solar protection screen or a privacy screen or image projection screen, a roller shutter. The invention also relates to a home automation device for closing, for solar protection, for privacy or for screening comprising such an actuator. The invention also relates to a method for producing such an actuator. Finally, the invention relates to an actuator obtained by such a production method.

The tubular home automation actuator comprises an actuator head system forming an end part of the actuator. The head system is intended to be mechanically connected to the structure of a building, via an attachment accessory that is attached to a casing, to the structure of the building or to a frame, particularly using attachment lugs, screws or rivet screws or any other attachment element. The connection of the head system to the attachment accessory preferably is detachable, i.e. easily locked or unlocked, in order to facilitate the installation or the maintenance of the home automation device or of the actuator. To this end, the various manufacturers have designed specific attachment accessories comprising, for example, resilient clipping means and shapes adapted to simultaneously take up the weight and the torque. The structure of the building thus takes up, via the attachment accessory, the forces of the head system, particularly some of the weight of the actuator, of the winding tube and of the roll-up element, typically half the weight. Furthermore, the structure of the building can take up, via the attachment accessory, all the torque of the actuator. Such an actuator is disclosed in patent application EP 2248987. The head system comprises a fixed piece, a ring forming a bush-bearing rotating relative to an actuator tube and a head. The fixed piece is fixed, on the one hand, to the actuator tube and, on the other hand, to the head. The head is attached, on the one hand, to the fixed piece and, on the other hand, is intended to be attached to the attachment accessory. Advantageously, the fixed piece is not directly connected to the attachment accessory and the head is not directly connected to the actuator tube.

The bush-bearing is mounted to rotate freely about the head, the fixed piece and the tube and is intended to receive the winding tube.

Another embodiment of a tubular home automation actuator is provided in application WO 2013/098108. The bush-bearing comprises internal toothing, which engages with a gear at the fixed piece forming part of a counting device of the actuator that is adapted to determine the rotations of the winding tube.

An actuator manufacturer preferably must offer an extensive range of actuators, which particularly differ by whether or not a head is present or by the shape of the head, in order to be able to adapt to various types of casings or accessories, or optionally to optimize the space (also called "light gap") between the attachment accessory and the winding tube, or even to allow the transmission of vibrations from the motor to the structure of the building to be reduced and thus reduce the operating noise. This results in a significant number of references, which complicates logistics and is a cost burden. If the actuator manufacturer attempts to streamline their offer and only provides a single type of head, they shift the problem onto the manufacturers of roll-up elements and force them to adopt an attachment solution that is not necessarily optimized for their products. Finally, the actuator and its head system in most cases have to meet impermeability constraints associated with the possible use of the actuator outside the building or in humid rooms. Similarly, a seal between the bush-bearing and the winding tube is also desirable, in order to contain any grease required for the gears and the toothed wheels of the counting devices.

The actuator is tested during production and is guaranteed by its manufacturer. It is obvious that this guarantee relates to the actuator as a whole, with its head system, and that a solution for the interchangeability of the head system or of part of the system becomes particularly risky if it is outside the industrial framework, for example, by being able to be produced on a site. The interchangeability of the head system requires at least one workshop intervention, within a framework that is agreed between the manufacturer of the actuator and the manufacturer integrating the actuator into their own product comprising the winding tube and/or the roll-up element. In order to simplify all these operations, the desire therefore is to customize the head of the actuator as much as possible (shape, material, visible color, etc.), whilst guaranteeing the correct operation of the actuator in all the configurations.

It is to be noted that several position counting solutions exist depending on the actuators. Counting actuators, called electromechanical counting actuators, use the fact that, with the bush-bearing being mechanically connected to the winding tube, the rotation of the bush-bearing brings about the rotation of the winding tube. In order to determine the angular position and the number of rotations performed by the winding tube, the bush-bearing can be provided with a toothed ring, meshing with a toothed gear of the actuator, which is connected to a rotation sensor. The bush-bearing then not only fulfills a bearing function, allowing the winding tube to rotate on the actuator while limiting friction, but also fulfills a counting assistance function. For electronic counting actuators, this mechanical meshing connection between the bush-bearing and the actuator is not necessary. In any case, another constraint is the requirement to mount a bush-bearing with a simple and solid structure (particularly a closed circular and non-deformable bush-bearing) and in a simple manner.

As mentioned previously, the shape of the head is generally specific to one actuator from a range of actuators. For example, it is star or round or narrow shaped. It integrates torque take up elements between the accessory and the actuator.

A solution for a head system is known from the aforementioned application EP 2248987, which system is in two parts comprising a fixed part partly pressed into the actuator tube and a head that is separately mounted and attached. In this application, attaching the head on the tube causes the fixed piece to be attached opposite the tube. The attachment is radial, in the vicinity of the actuator tube.

This document does not provide a complete solution to the aforementioned problems, nor does it allow freedom of design of the head system in terms of materials, interchangeability of parts and assembly.

The aim of the invention is to provide an actuator overcoming the aforementioned disadvantages and improving the known actuators of the prior art. In particular, the invention allows a simple and reliable actuator to be produced that allows interchangeability of the head, whilst simplifying the assembly of the head system.

According to a first aspect of the invention, a tubular home automation actuator for driving a winding tube comprises:

a tube;

a geared motor in the tube;

an output shaft at a first end of the tube; and a head system at a second end of the tube, the tube extending along the longitudinal axis.

The head system comprises:

a fixed piece;

a bush-bearing; and a head.

The actuator is such that:

the fixed piece and/or the tube form a bearing surface for rotationally guiding the bush-bearing about the longitudinal axis over the height or substantially over the height of the bush-bearing or the fixed piece forms a bearing surface for rotationally guiding the bush-bearing about the longitudinal axis, the bush-bearing partially covering the tube of the tubular home automation actuator;

the head comprises a bore having a first connecting element, particularly first splines, engaging with a second connecting element, particularly second splines, provided on the outer periphery of the fixed piece so as to rotationally connect, about the longitudinal axis, the head and the fixed piece;

the head comprises a stop element, particularly a face, axially stopping the bush-bearing along the longitudinal axis when the head is mounted on the fixed piece.

The bush-bearing thus comprises an axial guidance zone positioned opposite the fixed piece and/or optionally partially opposite the tube when the bush-bearing is assembled on the fixed piece. The axial guidance zone extends over the height of the bush-bearing or substantially over its height on the internal surface of the bush-bearing. It allows very precise centering of the bush-bearing on the fixed piece. Indeed, the chain of dimensions only comprises the fixed piece and the bush-bearing. Limiting the chains of dimensions, also limits the risks of any deviation from these dimensions and improves the acoustics, due to the friction of the parts rotating relative to one another. Thus, the centering and the rotational guidance of the bush-bearing is independent of the head.

The fixed piece can have a first stop element, particularly a first shoulder, axially stopping the bush-bearing along the longitudinal axis.

The tube can have a shoulder relative to the fixed piece, axially stopping the bush-bearing along the longitudinal axis.

The head can be in the form of a ring, provided with a central through-recess. The ring is defined by an outer and an inner perimeter that are substantially equivalent over its height. Thus, the end face of the fixed piece can be fully accessed through the head that is in the shape of a ring. This ensures that torque is taken up directly, and optionally only, through the fixed piece.

Preferably, the height of the head is less than or substantially equal to the height of the second connecting element, particularly the second splines, provided on the outer periphery of the fixed piece.

Advantageously, the head also can be omitted or be very short relative to its outer diameter. This allows its axial spatial requirement to be limited and thus optimizes the space (or light gap) between the attachment accessory and the winding tube. Thus, a home automation installation can comprise a first actuator provided with a first head engaging with the fixed piece and a second actuator without a head or with a specific head that is very short relative to its outer diameter. A specific head can be limited to a simple ring for translationally stopping the bush-bearing, the specific head being attached, for example, by clipping onto the fixed piece. In this case, the outer diameter of the head can be substantially equivalent to the maximum diameter of the bush-bearing.

The head can comprise a first position indexing element engaging with a second position indexing element provided on the fixed piece, so as to angularly position the head relative to the fixed piece.

The head can comprise a third connecting element, particularly a first hole, engaging with a fourth connecting element, particularly a second hole, provided on the fixed piece so as to stop, by engaging with a locking element, such as, for example, a shaft, a pin, a screw or a rivet, the head relative to the fixed piece along the longitudinal axis. Therefore, this corresponds to a locking that stops the head and the fixed piece relative to one another in terms of rotation about the longitudinal axis and translation along the longitudinal axis. To this end, a radial locking element is radially inserted into the head and into the fixed piece in order to fix these two parts opposite one another along the longitudinal axis. Thus, the third connecting element of the head is located between the inner perimeter and the outer perimeter of the head and the fourth connecting element emerges onto the outer perimeter of the fixed piece.

The fixed piece can comprise a toothed gear and the bush-bearing can comprise toothing, with the toothed gear and the toothing engaging by meshing.

The fixed piece can be formed to project out of the actuator tube after the fixed piece is assembled in the tube.

The bush-bearing can have a circular or annular shape that is closed or is designed to be closed.

The bush-bearing can comprise a ring gear integrally formed as a single part and a ring, particularly made of steel, mounted on an end of the ring gear. A steel ring has the following advantages:

it enhances the strength of the ring gear, the thickness of which is relatively thin in order to be housed between the actuator tube and the winding tube;

it enhances the wear resistance of the bush-bearing;

it provides the circularity for the bush-bearing.

The head can have a generally annular or ring shape.

An end face of the fixed piece can be accessed through the bore of the head.

The head can be mounted at a distance from the tube.

According to the first aspect of the invention, a home automation device for closing, for solar protection, for privacy or for screening, comprises a winding tube, an element for closing, for solar protection, for privacy or for screening attached to the winding tube and an actuator as previously described, housed in the winding tube, which tube is rotationally guided relative to the actuator by the bush-bearing.

According to the first aspect of the invention, a method for producing an actuator as previously described, comprises the following steps:

supplying the fixed piece, the fixed piece being optionally mounted and at least partially assembled in an actuator tube;

supplying the bush-bearing;

mounting the bush-bearing on the fixed piece, particularly mounting by sliding the bush-bearing on the bearing surface for rotationally guiding the fixed piece until it comes into contact with the first stop element;

supplying the head;

assembling the head on the fixed piece.

The step of supplying the head can comprise selecting a head from a plurality of different types of heads, particularly with different aspects, in particular with different geometries, with each head of the plurality of heads being adapted to be assembled on the fixed piece.

A second aspect of the invention relates to a bush-bearing for a tubular home automation actuator intended to be mounted in a winding tube of a home automation device for closing, for solar protection, for privacy or for screening.

According to this second aspect of the invention, the bush-bearing is defined by the following points:

a) bush-bearing for a tubular home automation actuator, the bush-bearing comprising:
   a one-piece ring gear; and
   a ring, particularly a steel ring, mounted on an end of the ring gear, the ring having an axial cylindrical portion attached to, particularly inserted in, the ring gear and a flat circular portion, perpendicular to the axial cylindrical portion;
b) bush-bearing according to point a), characterized in that the flat circular portion and the axial cylindrical portion are connected together by a curved portion;
c) bush-bearing according to point a) or b), characterized in that the bush-bearing has a closed circular shape, i.e. a non-slotted circular shape;
d) bush-bearing according to one of points a) to c), characterized in that the ring gear is integrally formed as a single part;
e) bush-bearing according to one of points a) to d), characterized in that the ring gear comprises internal toothing;
f) bush-bearing according to point e), characterized in that it comprises two internal guidance zones disposed on either side of the internal toothing.

According to the second aspect of the invention, a tubular home automation actuator for driving a winding tube comprises a bush-bearing as previously defined.

According to the second aspect of the invention, a home automation device for closing, for solar protection, for privacy or for screening, comprises a winding tube, an element for closing, for solar protection, for privacy or for screening attached to the winding tube and an actuator as previously defined, housed in the winding tube, which tube is rotationally guided relative to the actuator by a bush-bearing as previously defined.

Except for logical or technological incompatibility, all the features of the various aspects of the invention can be combined together. Thus, the invention also relates to any combination of features of the various aspects of the invention.

The appended drawings show, by way of an example, an embodiment of an actuator according to the invention.

FIGS. 7A to 7C are different views of a fixed piece of the embodiment of the tubular actuator according to the invention.

FIGS. 8A and 8B are different views of a first type of head of the embodiment of the tubular actuator according to the invention.

FIGS. 9A and 9B are different views of a second type of head of the embodiment of the tubular actuator according to the invention.

Figure 1:
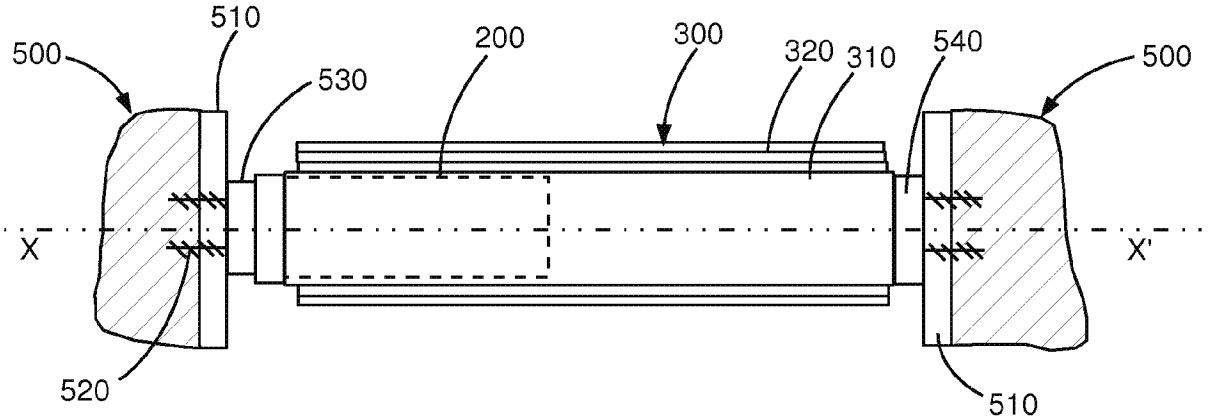
FIG. 1 shows an embodiment of a home actuation device comprising an embodiment of a tubular actuator according to the invention.
Figure 2:
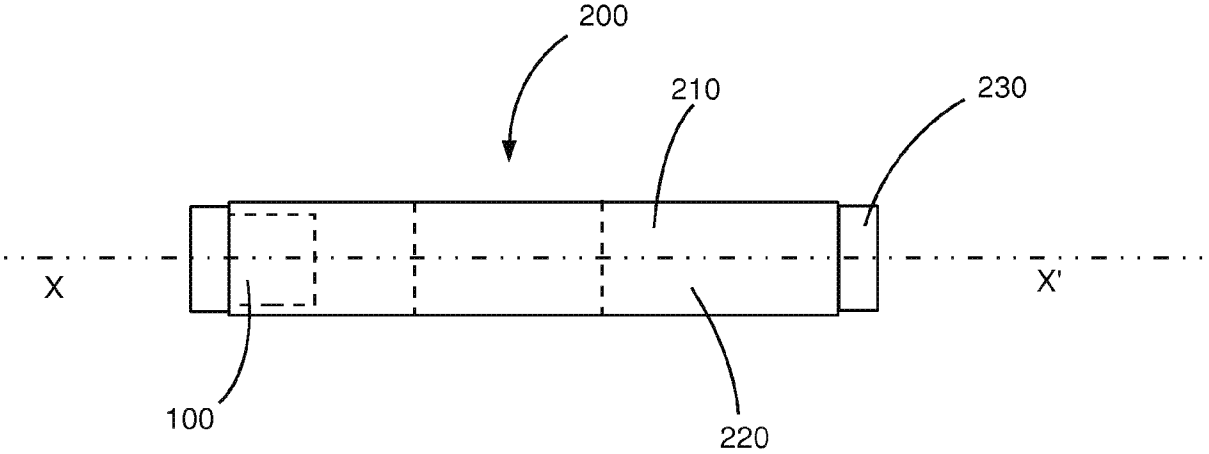
FIGS. 2 to 6 are different views of the embodiment of the tubular actuator according to the invention, with FIG. 3A being a partial section view along its longitudinal axis, FIGS. 3B and 3C being transverse section views, FIG. 5 being a perspective view without a head and FIG. 6 being a perspective view without a head and without a bush-bearing.
Figure 3A:
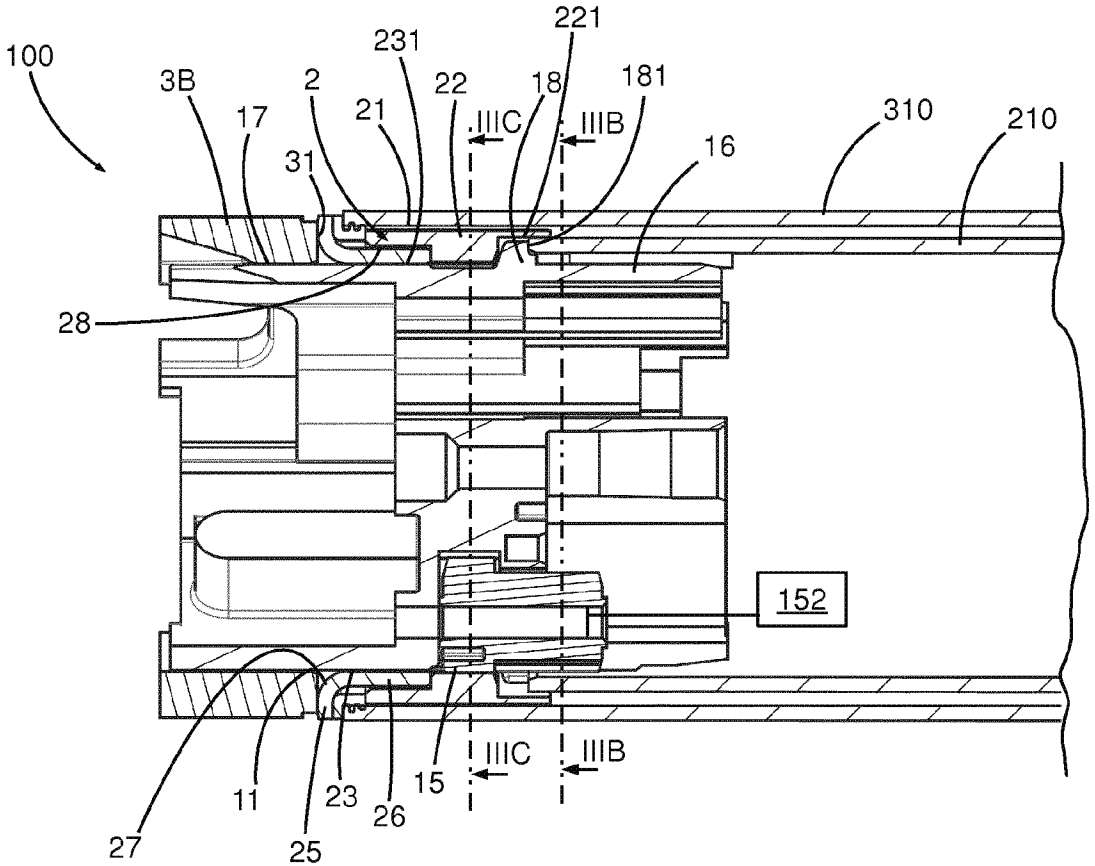
Figure 3C:
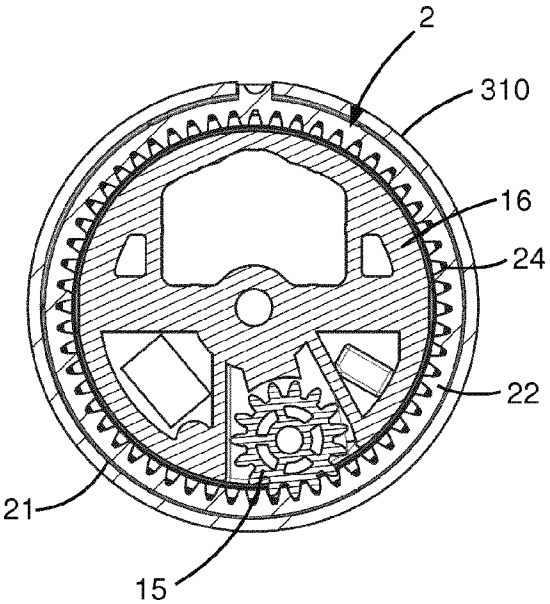
Figure 3B:
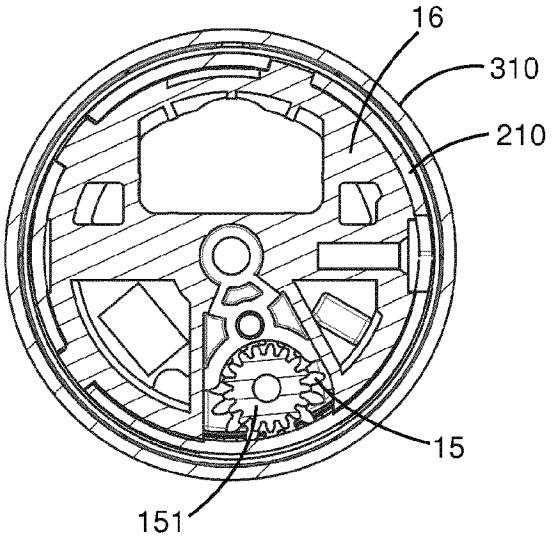
Figures 4, 5, 6:
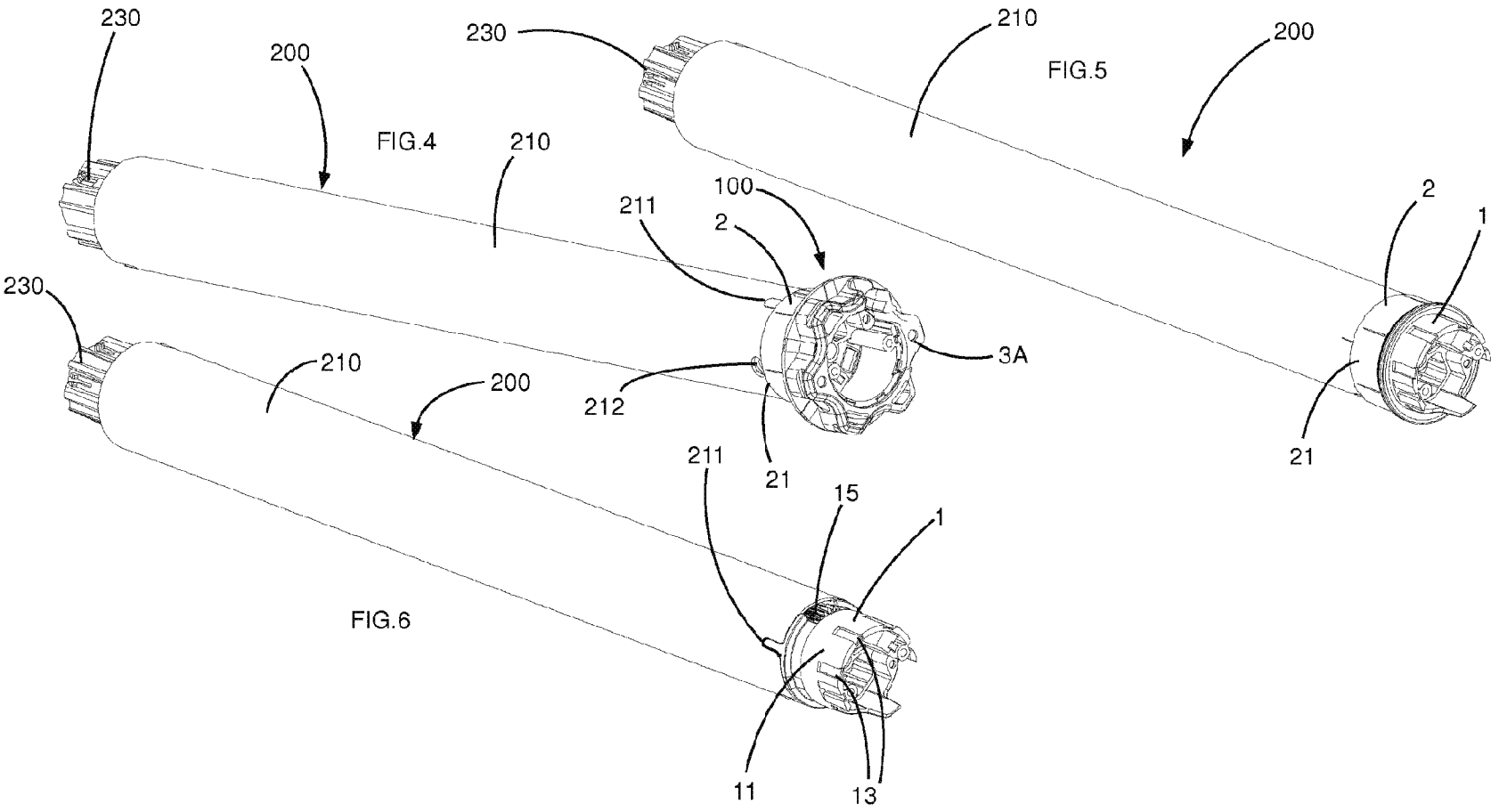

The embodiment of a device 300 according to the invention is described hereafter with reference to FIG. 1. The device is a home automation device for closing, for solar protection, for privacy or for screening. The home automation device comprises a winding tube 310, an element 320 for closing, for solar protection, for privacy or for screening attached to the winding tube and an actuator 200. The actuator is housed in the winding tube. The actuator comprises a bush-bearing 2 rotationally guiding the winding tube relative to the actuator.

The device 300 is mounted on a structure 500 of a building, particularly between two vertical walls forming the sides of an opening in a wall of the building. Optionally, the structure can comprise a casing 510, for example, a metal or plastic frame permanently fixed to the rest of the structure.

The device 300 is mounted on the structure via an attachment accessory 530. The attachment accessory is fixedly and rigidly mounted on the structure 500 or the casing 510, for example, by means of screws 520 or any other suitable attachment element. In particular, the attachment accessory is intended to receive the actuator at one of the ends thereof comprising a head system 100. The attachment accessory comprises to this end, for example corresponding forms. The attachment accessory thus allows indirect attachment of the head system and thus of the actuator to the structure 500. The connection between the attachment accessory and the head system preferably is of the embedded or closed type, i.e. the connection does not allow any degree of freedom. This connection between the attachment accessory and the head system advantageously is non-permanent and can be broken for an optional maintenance operation, then reassembled after this maintenance operation. Thus, for example, application EP 468925 discloses a ring and a resilient O-ring, the purpose of which is to immobilize the head of the actuator with respect to the accessory.

At the opposite end of the actuator, the winding tube is mounted on a second accessory 540 forming a bearing.

The winding tube 310 is rotationally movable relative to the structure 500 about a longitudinal axis X-X', particularly horizontal. The winding tube is rotated by the actuator. To this end, a drive wheel connects an output shaft 230 of the actuator to the winding tube. Depending on the direction of rotation of the output shaft of the actuator and, consequently, depending on the direction of rotation of the winding tube, the element 320 for closing, for solar protection, for privacy or for screening winds onto the winding tube or unwinds from the winding tube. Thus, the element 320 for closing, for solar protection, for privacy or for screening folds or unfolds.

The embodiment of the actuator 200 according to the invention is described hereafter with reference to FIGS. 2 to 6. The actuator comprises:

an actuator tube 210 extending along the longitudinal axis X-X';
a geared motor 220 disposed in the actuator tube;
the output shaft 230 disposed at a first end of the actuator tube; and
the head system 100 at a second end of the tube.

The output shaft is rotationally movable about the axis X-X'.

The actuator further comprises an electronic or electromechanical device for electrically powering the geared motor. The electronic or electromechanical device for electrically powering the geared motor advantageously comprises an electronic or electromechanical counting device. The counting device is arranged to be driven by the winding tube.

The head system 100 comprises:

a fixed piece 1;

a bush-bearing 2; and a head 3A of a first type or a head 3B of a second type.

The fixed piece is attached by closed connections, on the one hand, to the actuator tube and, on the other hand, to the head. These connections advantageously are non-permanent and can be broken for optional maintenance operations, then reassembled after these maintenance operations.

The head is fixed by a closed connection, on the one hand, to the fixed piece and is, on the other hand, intended to be attached by a closed connection to the attachment accessory. These connections advantageously are non-permanent and can be broken for optional maintenance operations, then reassembled after these maintenance operations.

Advantageously, the fixed piece is not directly connected to the attachment accessory and the head is not directly connected to the actuator tube.

An embodiment of a fixed piece is described hereafter with reference to FIGS. 7A to 7C. The fixed piece has a generally cylindrical shape. It comprises a first portion 16 and a second portion 17 separated by an intermediate portion 18 having a first shoulder 12 and a second shoulder 181. The portions 16 and 17 can have the same diameter. Alternatively, the diameter of the second portion 17 can be greater than that of the first portion 16, with this difference allowing the second shoulder 181 to be formed. Alternatively, the diameter of the second portion can be less than the diameter of the first portion, with the first shoulder 12 being able to be formed by the actuator tube itself. Advantageously, the first shoulder forms a stop element axially stopping the bush-bearing along the longitudinal axis X-X'. Alternatively, or additionally, the actuator tube 210 has a shoulder forming a stop element axially stopping the bush-bearing along the longitudinal axis X-X'.

The first portion 16 is formed to be housed in the actuator tube until it is axially stopped thereby along the axis X-X' through contact of the end of the actuator tube against the second shoulder 181. Thus, the fixed piece is formed to project out of the actuator tube after the fixed piece is assembled in the tube. Additionally, the actuator tube comprises one or more grooves 211 arranged to receive one or more ribs 161 provided on the first portion of the fixed piece to rotationally stop the actuator tube about the axis X-X' relative to the fixed piece. The presence of one or more ribs engaging with one or more grooves unevenly distributed about the axis X-X' also enables indexing of the position of the winding tube and the fixed piece. The first portion 16 comprises a first hole 182 arranged to engage with a second hole 212 arranged on the actuator tube to receive a locking element such as a screw, a rivet or a pin. The fixed piece thus can be locked in the actuator tube, independently of the other parts of the head system.

The second portion 17 exceeds the end of the actuator tube. The bush-bearing is inserted on the second portion until it is axially stopped thereby along the axis X-X' through contact of the bush-bearing against the first shoulder 12 or against the actuator tube.

The head is formed to be housed around the second portion 17 until it is axially stopped thereby along the axis X-X'. The head comes into contact against the bush-bearing, the axial translation movement of which is stopped on the second portion. Additionally, the head comprises one or more splines 33 arranged on an inner part to engage with splines 13 provided on an outer part of the second portion 17 of the fixed piece to rotationally stop the head about the axis X-X' relative to the fixed piece. The presence of splines unevenly distributed about the axis X-X', or having different widths, also enables indexing the position of the head and the fixed piece. Thus, the head can comprise a first position indexing element 33 engaging with a second position indexing element 13 provided on the fixed piece so as to angularly position the head relative to the fixed piece. The second portion comprises a third hole 14 arranged to engage with a fourth hole 34 arranged on the head to receive a locking element 4 such as a screw, a rivet or a pin. The fixed piece thus can be axially locked in the head. Consequently, the head can comprise a third connecting element 34, particularly the fourth hole 34, engaging with a fourth element 14, particularly the third hole 14, provided on the fixed piece so as to stop, by engaging with the locking element, the head relative to the fixed piece along the longitudinal axis X-X'.

The splines 33 and 13 advantageously are formed to translationally stop, along the axis X-X', the head relative to the second portion 17 of the fixed piece.

The fixed piece comprises, on its second portion 17, a bearing surface 11 for rotationally guiding the bush-bearing 2 about the longitudinal axis X-X'. This bearing surface 11 engages with a bore of the bush-bearing to provide this guidance.

Advantageously, the fixed piece 1 and/or the actuator tube form the bearing surface 11 for rotationally guiding the bush-bearing 2 about the longitudinal axis X-X' over the height or substantially over the height of the bush-bearing 2. The bearing surface may not be continuous over the entire height of the bush-bearing, in particular it can be interrupted at the internal toothing 24 of the bush-bearing. However, advantageously, the fixed piece 1 forms a first bearing surface portion 11 for rotationally guiding the bush-bearing 2 about the longitudinal axis X-X' and/or the actuator tube forms a second bearing surface portion 11 for rotationally guiding the bush-bearing 2 about the longitudinal axis X-X' over the height or substantially over the height of the bush-bearing 2. More preferably, with the actuator being assembled, the first bearing surface portion is located at a first end of the bush-bearing and the second bearing surface portion is located at a second end of the bush-bearing.

The fixed piece also comprises an opening 183. This opening receives a toothed gear 15 movably mounted about an axis parallel to the axis X-X' and for which some teeth exceed the diameter of the second portion. This toothed wheel is in kinematic connection, particularly by meshing:

with the electromechanical counting device, and with an internal toothing 24 of the bush-bearing 2 when it is in a position translationally stopped by the second shoulder after having been guided on the second portion.

In particular, the toothed gear 15 is connected to a toothed wheel 151, which is connected to a rotation sensor 152 that is schematically shown. Measuring the angular position of the toothed wheel allows the angular position of the winding tube to be deduced and consequently allows the position of the roll-up element to be deduced.

An embodiment of a head is described hereafter with reference to FIGS. 8A to 9B. The head can be of a first type, as shown in FIGS. 8A and 8B, or of a second type, as shown in FIGS. 9A and 9B. The head also can have another appearance or another aspect, in particular a different geometry. Nevertheless, regardless of this appearance, the head is adapted in order to be able to be attached on the fixed piece. Indeed, the appearance of the head particularly allows it to be assembled on a given attachment accessory. Thus, a first type of head is adapted to be mounted on a first type of attachment accessory and a second type of head is adapted to be mounted on a second type of attachment accessory. The types of head also can vary in terms of their color or their material.

The head 3A, 3B has a generally annular or ring shape. It therefore comprises a central bore 32 having a first connecting element 33, particularly the first splines 33 previously described, engaging with a second connecting element 13, particularly the second splines 13 previously described, provided on the outer periphery of the fixed piece 1 so as to rotationally connect, about the longitudinal axis X-X', the head and the fixed piece.

The central bore 32 is such that once the head is assembled on the fixed piece, an end face 171 of the fixed piece 1 is accessible through this bore. Thus, the bore enables easy insertion of an electrical cable and/or of an optional connector at the end of this cable.

The head also comprises a stop element 31, particularly a face 31, axially stopping the bush-bearing along the longitudinal axis when the head is mounted on the fixed piece after the bush-bearing.

Once mounted on the fixed piece, the head is mounted at a distance from the actuator tube. The bush-bearing is interposed between the head and the first shoulder 12. The head barely does not exceed the fixed piece (a few millimeters) when it is assembled and attached on the fixed piece by the locking element.

The bush-bearing 2 has an annular shape, particularly a closed annular shape, i.e. unbroken on its periphery or non-slotted, particularly on its inner periphery. It has a bore intended to engage with the bearing surface 11 of the second portion 17 of the fixed piece in order to guide the ring on the fixed piece. It also has a bearing surface 21 intended to receive the winding tube. Thus, the bush-bearing allows the winding tube 310 to be guided relative to the actuator. The bearing surface 21 and the winding tube are formed so that the bush-bearing and the winding tube are mounted as a closed connection one relative to the other. The bush-bearing and the winding tube thus are attached to each other by any suitable means (play-free press-fitting, positive connection, particularly by a staple formed on the outside of the bush-bearing and engaging with a groove produced in the end of the winding tube, etc.). The bush-bearing also comprises the internal toothing provided to mesh with the toothed wheel provided in the fixed piece. Thus, rotating the winding tube rotates the toothed wheel mounted in the fixed piece and allows the angular position of the winding tube to be counted.

The bush-bearing advantageously comprises three cylindrical parts assembled together, but also can be made as one-piece from plastic. According to a preferred embodiment of the invention, the bush-bearing comprises a first one-piece cylindrical part or ring gear 22, on the inside of which the internal toothing 24 is formed as an overthickness. With the ring gear having a thin section, it is important that it is produced as a single part, so as to guarantee its stiffness and to avoid deformations. If such deformations occur, this generates friction problems (of the winding tube against the actuator), and even jerking slippage phenomena (also called jumping phenomena).

The second part is a cylindrical one-piece ring 23 made of steel, particularly obtained by stamping. It has an axial cylindrical portion or section 26, which inserts into the first cylindrical part of the bush-bearing and is fixed thereto, for example, by adhesion. It particularly comes into abutment on the overthickness formed by the internal toothing 24 of the first cylindrical part. It allows the ring gear to be stiffened. It also has a flat circular portion or section 25, perpendicular to the axial cylindrical section 26 and connected thereto by a curvature 27 or a curved portion 27. This flat circular section comes into contact with the head, particularly with the stop element 31 of the head, when said head is assembled on the fixed piece. A slight clearance can remain between these two parts, but when the actuator is assembled in the winding tube, the winding tube is resiliently forced toward the attachment accessory of the actuator and thus the bush-bearing is brought into contact with the head. The flat circular surface 25 therefore also fulfills a function of bearing surface during the operation of the actuator, with the bush-bearing being rotationally movable, whereas the head is fixed.

A third part comprising a seal 28, or consisting in a seal 28, can be inserted between the ring gear 22 and the steel ring 23 of the bush-bearing and can be held between an end of the ring gear and the flat circular section. This rigid elastomer seal is a seal that can adapt to the various dimensions of the various winding tube manufacturers. The seal also can be produced by an overmolding of the steel ring and of the ring gear.

The bush-bearing comprises two internal axial guidance zones 231, 221 disposed on either side of the internal toothing. A first internal axial guidance zone 231 is intended to engage with the fixed piece in order to rotationally guide the bush-bearing on the fixed piece. This first zone 231 advantageously is the internal surface of the axial cylindrical section 26. The contact with the fixed piece, which is preferably made of plastic material, advantageously is a metal-plastic contact. A second internal axial guidance zone 221 is intended to engage with the actuator tube 210 in order to rotationally guide the bush-bearing on the tube 210. This second zone 221 advantageously is a cylindrical internal surface of the ring gear. The contact with the actuator tube, which preferably is made of a metal material, advantageously is a metal-plastic contact. Alternatively, in the absence of internal toothing, the axial guidance zone extends over substantially the entire height of the bush-bearing.

Once mounted, the bush-bearing 2 can partially cover the actuator tube. This particularly allows the grease to be contained that is optionally required for meshing the gears and toothed wheels of the counting devices. Indeed, with such a geometry, the bush-bearing and the actuator tube create a baffle. It also partially covers the fixed piece. It is translationally blocked between the head and the fixed piece or between the head and the actuator tube.

The bush-bearing advantageously is one-piece or is integrally formed as a single part. Preferably, it is non-deformable. In particular, it is not deformed when it is assembled on the fixed piece. Thus, the bush-bearing is easily obtained by molding. It is assembled on the rest of the head system with a minimum number of operations on the fixed piece, particularly by sliding on the second portion of the fixed piece, on the side opposite the output shaft of the actuator.

An embodiment of a method for producing or manufacturing an actuator as previously described is described hereafter.

The method comprises the following steps:

- supplying the fixed piece 1, the fixed piece being optionally mounted and at least partially assembled in an actuator tube 210;
- supplying the bush-bearing 2;
- mounting the bush-bearing on the fixed piece 1, particularly mounting by sliding the bush-bearing on the bearing surface 11 for rotationally guiding the fixed piece until it comes into contact with the first stop element, with the first stop element being formed on the fixed piece and/or on the winding tube;
- supplying the head 3A; 3B;
- assembling the head on the fixed piece 1.

Mounting the head on the fixed piece 1 allows the bush-bearing to be axially immobilized on the fixed piece, with the bush-bearing then being confined or interposed between the first stop element and the head.

Advantageously, the step of supplying the head comprises selecting a head from a plurality of different types of heads 3A, 3B, particularly with different aspects, in particular with different geometries, with each head of the plurality of heads being adapted to be assembled on the fixed piece.

Depending on the type of head, the mechanical torque can be transferred to the structure either via the head (for example, in the case of a star-shaped head, as shown in FIGS. 8A and 8B), or by other suitable means directly at the fixed piece (for example, in the case of a cylindrical head, as shown in FIGS. 9A and 9B and where no external shape allows torque take up, with the torque being taken up by the fixed piece in this case). Alternatively, the mechanical torque can be transferred partially by the head and partially by the fixed piece. If the torque to be transferred is relatively low, if the torque is transferred directly by the fixed piece or if the torque is only partially transferred by the head, this allows different materials to be used for the fixed piece and for the head. The material used for the head can be less rigid and less subject to technical constraints. This allows considerable freedom to be provided for producing the head. In particular, the fact that the end face 171 of the fixed piece is accessible through the bore of the head grants access to the fixed piece, either for maintenance, electrical connection or torque take up directly at the fixed piece.

The proposed solution allows the type of head to be changed (color, brand, shape, plastic material), with customization that is easily performed as a final operation, from a sealed and closed actuator body, by virtue of the fixed piece. Customization using a head from a standard actuator body therefore is simple and the number of references in the plant is reduced. It is possible to contemplate performing this customization at the end of production or during the logistics phase, on request.

Unlike the solutions of the prior art, it is to be noted that with the invention the bush-bearing can be mounted on the actuator via the end of the head and not via the end at which the output shaft of the actuator is located. Thus, the use of bush-bearings with a deformable part can be avoided, for example, bush-bearings in the form of half-rings to be axially assembled on the actuator, by deforming them, or bush-bearings translationally attaching along the actuator (for example, by resilient deformation, for example, by clipping) after having been mounted via the end at which the output shaft of the actuator is located. However, these latter solutions for bush-bearings with a deformable part are still compatible with the invention.

Preferably, the bush-bearing is intended to be mounted to rotate freely about the fixed piece, in particular to be mounted to rotate freely directly on the fixed piece, and is intended to receive the winding tube, particularly to be at least partially housed in the winding tube.

Preferably, throughout this document, unless otherwise stated, the height of a part or of an element is measured along the longitudinal axis X-X' of the actuator.

The invention claimed is:

1. A bush-bearing in combination with a tubular home automation actuator, the bush-bearing comprising:

a one-piece ring gear; and a ring mounted on an end of the ring gear, the ring having an axial cylindrical portion attached to the ring gear and a flat circular portion perpendicular to the axial cylindrical portion, wherein the flat circular portion and the axial cylindrical portion are connected together by a curved portion, wherein the tubular home automation actuator comprising:

an actuator tube;

a geared motor in the actuator tube;

an output shaft at a first end of the actuator tube; and a head system at a second end of the actuator tube, the actuator tube extending along a longitudinal axis, the head system comprising:

a fixed piece;

the bush-bearing; and a head, and wherein (i) the fixed piece and/or the actuator tube form a bearing surface for rotationally guiding the bush-bearing about the longitudinal axis over a height or substantially over the height of the bush-bearing, or (ii) the fixed piece forms a bearing surface for rotationally guiding the bush-bearing about the longitudinal axis, wherein the bush-bearing partially covers the actuator tube of the tubular home automation actuator.

2. The bush-bearing as claimed in claim 1, wherein the bush-bearing has a closed, non-slotted circular shape.

3. The bush-bearing as claimed in claim 1, wherein the ring gear is integrally formed as a single part.

4. The bush-bearing as claimed in claim 1, wherein the ring gear comprises internal toothing.

5. The bush-bearing as claimed in claim 4, wherein the bush-bearing comprises two internal guidance zones disposed on either side of the internal toothing.

6. A home automation device for closing, for solar protection, for privacy or for screening, comprising:

a winding tube, an element for closing, for solar protection, for privacy or for screening attached to the winding tube, and the tubular home automation actuator as claimed in claim 1, wherein the actuator is housed in the winding tube, and wherein the winding tube is rotationally guided relative to the actuator by the bush-bearing as claimed in claim 1.

7. A tubular home automation actuator for driving a winding tube, comprising:

a tube;

a geared motor in the tube;

an output shaft at a first end of the tube; and a head system at a second end of the tube, the tube extending along a longitudinal axis, the head system comprising:

a fixed piece;

a bush-bearing; and a head, wherein (i) the fixed piece and/or the tube form a bearing surface for rotationally guiding the bush-bearing about the longitudinal axis over a height or substantially over the height of the bush-bearing, or (ii) the fixed piece forms a bearing surface for rotationally guiding the bush-bearing about the longitudinal axis, wherein the bush-bearing partially covers the tube of the tubular home automation actuator;

the head comprises a bore having a first connecting element engaging with a second connecting element provided on an outer periphery of the fixed piece so as to rotationally connect, about the longitudinal axis, the head and the fixed piece; and the head comprises a stop element axially stopping the bush-bearing along the longitudinal axis when the head is mounted on the fixed piece.

8. The tubular home automation actuator as claimed in claim 7, wherein the fixed piece has a first stop element axially stopping the bush-bearing along the longitudinal axis.

9. The tubular home automation actuator as claimed in claim 7, wherein the tube has a shoulder relative to the fixed piece, axially stopping the bush-bearing along the longitudinal axis.

10. The tubular home automation actuator as claimed in claim 7, wherein the head comprises a first position indexing element engaging with a second position indexing element provided on the fixed piece so as to angularly position the head relative to the fixed piece.

11. The tubular home automation actuator as claimed in claim 7, wherein the head comprises a third connecting element engaging with a fourth connecting element provided on the fixed piece so as to stop, by engaging with a radial locking element the head relative to the fixed piece along the longitudinal axis.

12. The tubular home automation actuator as claimed in claim 7, wherein the fixed piece comprises a toothed gear and the bush-bearing comprises toothing, the toothed gear and the toothing engaging by meshing.

13. The tubular home automation actuator as claimed in claim 7, wherein the fixed piece is formed to project out of the tube of the actuator after the fixed piece is assembled in the tube.

14. The tubular home automation actuator as claimed in claim 7, wherein the bush-bearing has a closed circular shape.

15. The tubular home automation actuator as claimed in claim 7, wherein the bush-bearing comprises a ring gear integrally formed as a single part and a ring mounted on an end of the ring gear.

16. The tubular home automation actuator as claimed in claim 7, wherein the head has a generally annular or ring shape.

17. The tubular home automation actuator as claimed in claim 7, wherein an end face of the fixed piece is accessible through the bore of the head.

18. The home automation actuator as claimed in claim 7, wherein the head is mounted at a distance from the tube.

19. A home automation device for closing, for solar protection, for privacy or for screening, wherein the home automation device comprises:

a winding tube, an element for closing, for solar protection, for privacy or for screening attached to the winding tube, and the tubular home automation actuator as claimed in claim 7, wherein the actuator is housed in the winding tube, and wherein the winding tube is rotationally guided relative to the actuator by the bush-bearing.

* * * * *